United States Patent [19]

Salisbury et al.

[11] 3,998,281

[45] Dec. 21, 1976

[54] EARTH BORING METHOD EMPLOYING HIGH POWERED LASER AND ALTERNATE FLUID PULSES

[76] Inventors: Winfield W. Salisbury, 11 Glenn Road, Belmont, Mass. 02178; Walter J. Stiles, Tuscon House, Tuscon, Ariz. 85705

[22] Filed: Nov. 20, 1974

[21] Appl. No.: 525,442

[52] U.S. Cl. ..... 175/16; 299/14

[51] Int. Cl.[2] ..... E21B 7/14; E21C 21/00

[58] Field of Search ..... 175/11, 16; 299/14

[56] References Cited

UNITED STATES PATENTS

| | | | |
|---|---|---|---|
| 914,636 | 3/1909 | Case | 175/15 X |
| 2,548,463 | 4/1951 | Blood | 175/15 X |
| 3,539,221 | 11/1970 | Gladstone | 175/16 X |
| 3,544,165 | 12/1970 | Snedden | 175/16 X |
| 3,556,600 | 1/1971 | Shoupp et al. | 175/16 X |
| 3,693,718 | 9/1972 | Stout | 175/16 |
| 3,882,945 | 5/1975 | Keenan | 175/16 |

OTHER PUBLICATIONS

"Novel Drilling Techniques," by Wm. C. Maurer, Mar. 1968, N. Y. Pergamon Press.

*Primary Examiner*—Ernest R. Purser
*Attorney, Agent, or Firm*—J. Patrick Cagney

[57] ABSTRACT

A method of earth boring, useful for oil well drilling and the like, employs a high powered laser beam focused and directed by appropriate optics and/or scanning means to a vertically downwardly directed annular pattern. A fluid blast means directed generally into the bore hole is disposed adjacent the beam between the earth and the optics or scanning means. The beam and fluid blast are alternately pulsed and the fluid blast is effective to create thermal shock in the core to shatter it and to deflect material cleared from the hole by the laser beam away from the boring apparatus.

15 Claims, 5 Drawing Figures

Fig. 1
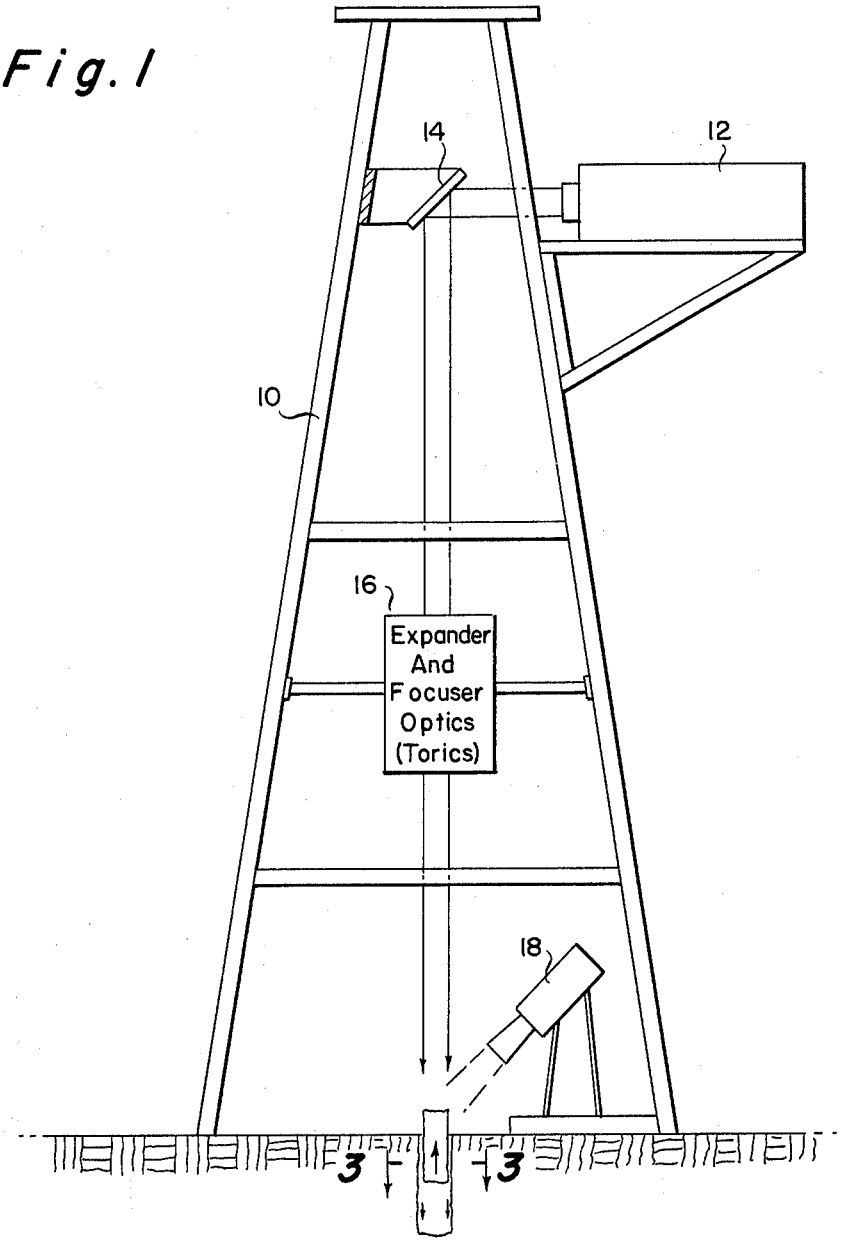
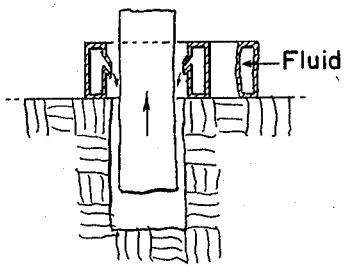
Fig. 2
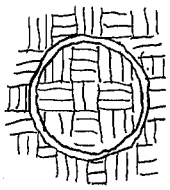
Fig. 3

EARTH BORING METHOD EMPLOYING HIGH POWERED LASER AND ALTERNATE FLUID PULSES

BACKGROUND OF THE INVENTION AND CROSS REFERENCE TO RELATED PRIOR ART

High powered lasers are presently in an extremely active stage of development and it has already been proposed to use such lasers in various earth working applications. Examples may be found in the following two U.S. patents:

Snedden, U.S. Pat. No. 3,544,165, 1970;
Gladstone, U.S. Pat. No. 3,539,221, 1970.

The problem in attempting to apply the teaching of such patents to drilling, for example a hole 30cm in diameter and 5km deep is that even by using the most advanced form of lasers known today too much energy would probably be required to vaporize a cylinder of that size from the earth's crust. Some other approach therefore, seems necessary in order to reduce the total amount of energy input required and hence the cost for boring a hole this size.

BRIEF SUMMARY OF THE INVENTION

The present invention solves the problem by focusing and/or scanning a laser beam or beams in an annular pattern directed substantially vertically downwardly onto the strata to be bored. The actual annular area to be vaporized by the laser beam therefore, would be only a small fraction of the total diameter of the hole. By pulsing the laser beam, alternately with a fluid blast on the area to be bored, not only will the annulus be vaporized, but the core of the annulus will be shattered by thermal shock and the pressure created on the underside by the vaporization of the annular area will be sufficient to raise the core material to the surface in fragments. The horizontal component of the fluid blast pulsed alternately with the laser beam will also deflect the core material away from the drilling apparatus.

BRIEF DESCRIPTION OF THE DRAWINGS

FIG. 1 is a diagrammatic view in side elevation to illustrate the basic system of the present invention;

FIG. 2 is a showing of one possible configuration of a nozzle for directing the fluid blast into the area being bored;

FIG. 3 is a section on the lines 3—3 of FIG. 1 indicating the configuration of the bore hole as it is initially formed in the earth by vaporization of the earth crust by the laser beam alone;

DETAILED DESCRIPTION OF THE DRAWINGS

Figure 4:
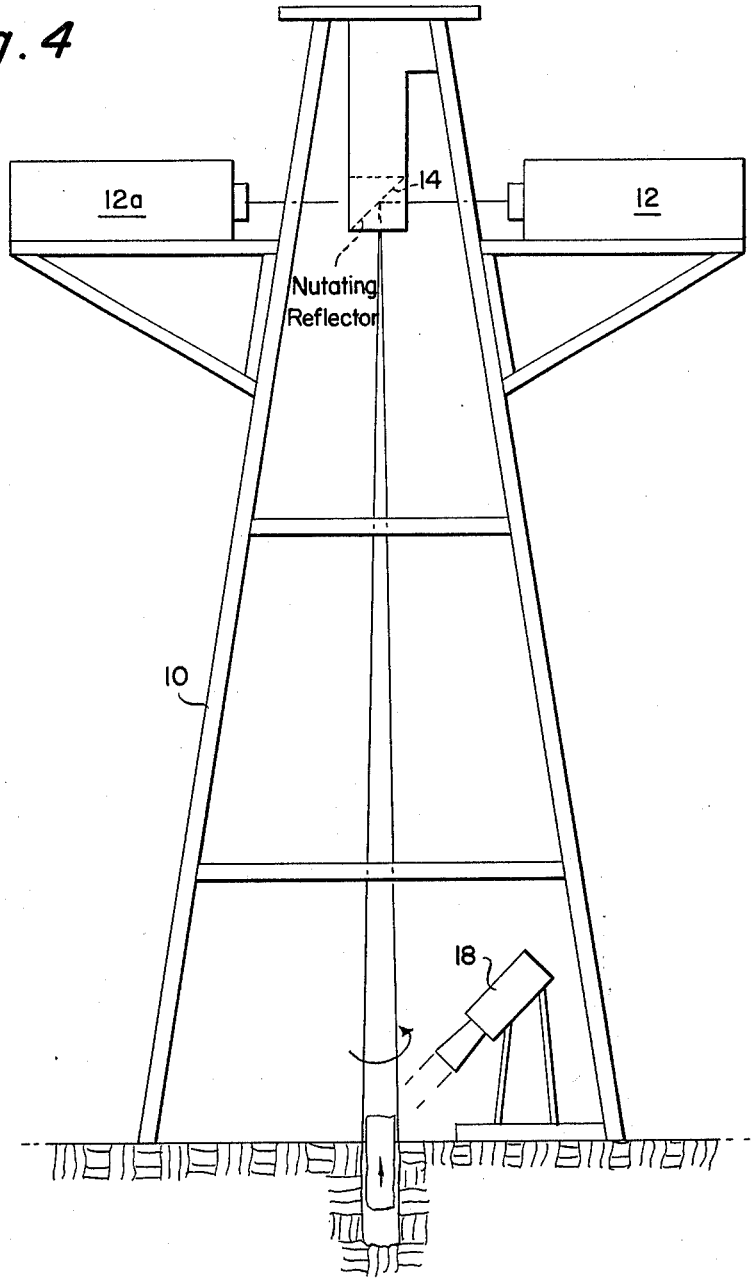
FIG. 4 is a view similar to FIG. 1 in which the laser beam is caused to scan in a circular path to create an annular pattern in the working area.

To give a detailed description of the present invention let us assume that what we want to produce is a vertically arranged cylindrical hole in the earth's crust approximately 30cm in diameter and 5km long. The volume of such a hole would be 350 cubic meters. Further assuming that the approximate density of the material to be removed to form such a hole is 3, for a slightly heavy rock, this would be about $10^6$ kilograms of rock to be melted and vaporized or roughly 1,000 long tons. Further assuming an average heat capacity of 2/10 calories per gram per degree centigrade, and a combined heat of fusion and vaporization of about 100 calories per gram, the process would require $17 \times 10^{12}$ Joules if the drilling could proceed fast enough locally so that conduction losses would be relatively negligible. The energy equivalent to do the job can be calculated to be $4.8 \times 10^6$ kilowatt hours. If we could operate a 10 megawatt laser for approximately 20 days continuously, it would do the job but even at a cost of 5 cents per kilowatt hour, this would still represent about $240,000.00 worth of energy alone. Other factors which were eliminated from the calculation to simplify it are things such as laser efficiency and thermal losses during the drilling. In order to greatly reduce the energy required, the present invention proposes a means for concentrating the energy of a laser beam into an annular pattern for example, about 1cm wide and having an outer diameter equal to the desired diamter of the bore hole. Secondly, the present invention contemplates pulsing the laser beam so as to obtain very high peak powers for short time durations to promote thermal shock of the core material within the annulus and thus break the core up into small particles which will be forced upwardly out of the hole by the pressure of the material which is actually vaporized by the laser beam. With this approach, the mass of matter required to be vaporized by the laser beam could be reduced by a factor of about 7 ¾, resulting in an energy cost reduction to about $31,000.00

Referring now to FIG. 1 of the drawings, one possible arrangement for practicing the present invention is diagrammatically illustrated. An oil well drilling tower or derrick 10 is positioned as usual over the area to be drilled. A laser 12 is shown as supported by the drilling derrick but obviously it could be independently supported immediately adjacent the derrick. Coherent light from the laser 12 is reflected vertically downwardly as indicated at 14. In order that the laser beam will have an annular pattern when it reaches the surface of the ground, an optical system generally indicated at 16 is employed. Reflector optics which can be liquid cooled are ideal for this purpose and a discussion of such devices may be found in an article entitled "Toric Catoptrics" by D. S. Banks at pages 13–19 inclusive of a publication entitled "Electronic Progress" volume 17, Number 2, Summer 1974, published by Raytheon Company. Any conceivable type of focusing is possible employing the optical principles set forth in the publication including such features as "Zoom" focusing and the like.

As indicated in FIG. 3, the shape of the coherent light beam exiting from the optical system 16 may then be annular and the thickness of the annulus may be accurately controlled.

Also diagrammatically illustrated in FIG. 1 is a means 18 for creating a fluid blast directed onto the core of the annulus of the coherent beam from the laser in order to assist in shattering the core by thermal shock and to deflect materials coming up out of the hole and push them to one side thus preventing them from striking either the optical system 16 or other parts of the drilling apparatus.

The system shown in FIG. 4 is similar to the one shown in FIG. 1 except that the laser beam instead of being focused into an annular pattern is focused to a point and the point is then caused to scan in an annular pattern. One way of achieving this is shown schematically in FIG. 4 as a means for causing the mirror 14 to nutate. Also as shown in this Figure, additional lasers such as indicated at 12*a* may be employed so that a plurality of beams will be scanned around the annulus.

Figure 5:
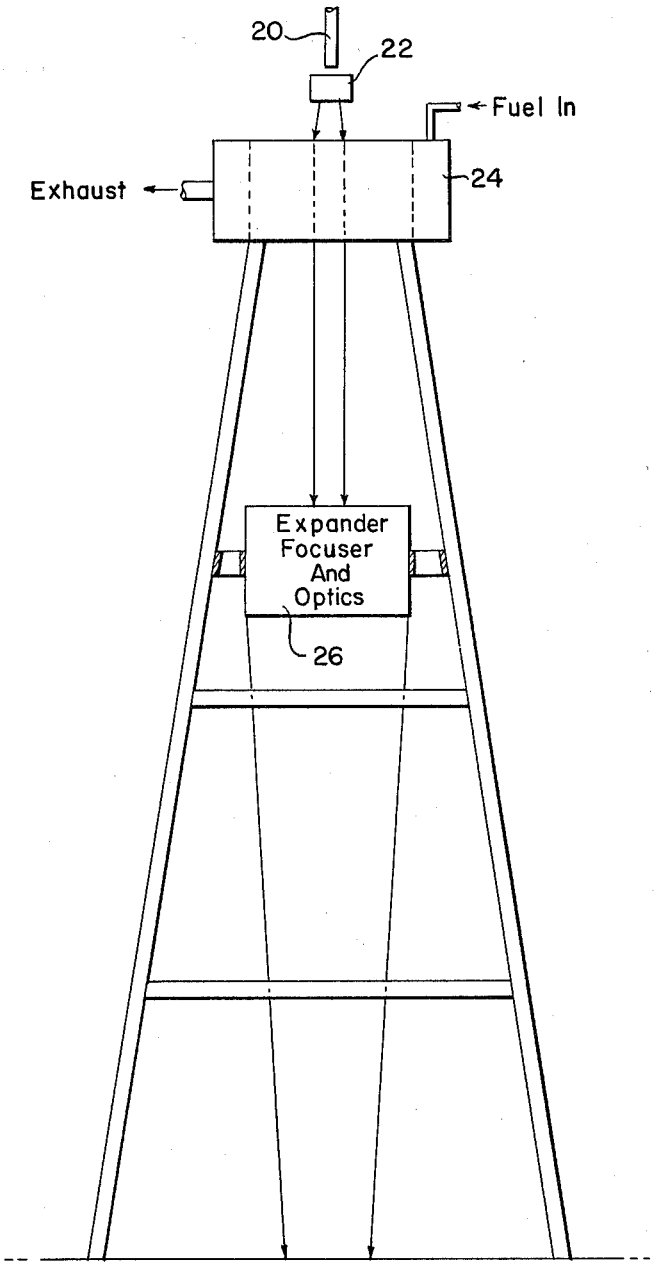
FIG. 5 is a view similar to FIG. 1 but showing an electrical laser with a gaseous fuel, light amplifier to achieve a coherent light beam of the desired energy.

In FIG. 5, a further alternative to the energy sources depicted in FIGS. 1 and 4 is shown. In this case the source of coherent light may be an electrical laser 20 the output of which goes through a beam expander 22 and then through a light amplifier 24 of the so-called T.E.A. type. One such device is described in "Physics Today", July 1970, pages 55 and 56. The amplified coherent beam from the amplifier 24 is then passed through further expander and focuser optics at 26 and then focused onto the earth's surface as in FIG. 1.

The following currently available lasers would appear to have utility in this application:

A. Hydrofluorine chemically driven laser operating at 2.6 microns wavelength.

B. $CO_2$ laser operating at 10.6 microns wavelength

C. Solid state lasers such as Neodymium glass operating at 1.06 microns.

The duration and/or frequency of pulses of either the laser or the fluid blast will be subject to considerable variation but as an example both pulses could be of the order of seconds in duration.

It is contemplated that all operation characteristics of the system such as pulse length, frequency, area and diameter of annular area contacted, power input and operating wavelength of the source of coherent light are subject to continuous variation and control depending on such factors as the physical properties of the strata being bored.

From the foregoing it will be apparent to those skilled in the art that there is herein shown and disclosed a new and useful system and method for earth boring employing laser technology and applicants claim the benefit of a full range of equivalents within the scope of the appended claims.

We claim:

1. A method of earth boring comprising fusing successive annular regions of the stratum to be penetrated to shatter and eject successive cores from the strata by directing a high powered coherent light beam downwardly onto each successive annular region from a location above the stratum to be penetrated; pulsing said beam at a pre-determined rate; directing a fluid blast in contact with the strata contacted by said beam and pulsing said fluid blast alternately with said beam to shatter the core and clear away material thus removed from the earth.

2. The method of claim 1 in which said fluid is gaseous.

3. The method of claim 1 in which said fluid is liquid.

4. The method as defined by claim 1 in which said coherent light beam is the output of a hydrofluorine chemically driven laser operating at 2.6 microns wavelength.

5. The method as defined by claim 1 in which said coherent light beam is the output of a $CO_2$ laser operating at 10.6 microns wavelength.

6. The method as defined by claim 1 in which the source of said coherent light beam is solid state laser.

7. A method as defined by claim 1 including the step of focusing said beam into an annulus of the desired hole diameter.

8. A method as defined by claim 7 including varying the thickness of said annulus in accordance with physical properties of the strata being bored.

9. The method as defined by claim 7 including varying the frequency and duration of pulses depending upon the physical properties of the strata being bored.

10. The method as defined by claim 1 including focusing said beam substantially to a point and thereafter deflecting said beam in a circular pattern so that the area scanned is an annulus the outer diameter of which is substantially equal to the desired hole diameter.

11. A method as defined by claim 10 including varying the thickness of said annulus in accordance with physical properties of the strata being bored.

12. The method as defined by claim 10 including varying the frequency and duration of pulses depending upon the physical properties of the strata being bored.

13. A method of earth boring comprising fusing successive annular regions of the stratum to be penetrated to shatter and eject successive cores from the strata by directing at least one high powered coherent light beam downwardly onto the annular region from a location above the stratum to be penetrated; focusing said beam substantially to a point on the stratum to be penetrated; deflecting said beam in a circular path so the area scanned is annulus of the desired thickness and external diameter; directing a fluid blast in contact with the strata contacted by said beam and pulsing said blast and said beam alternately.

14. The method as defined by claim 13 employing a plurality of coherent light beams.

15. The method as defined by claim 13 including controlling the thickness of said annulus in accordance with physical properties of the strata being bored.

* * * * *